US006367567B1

(12) United States Patent
Massa et al.

(10) Patent No.: US 6,367,567 B1
(45) Date of Patent: Apr. 9, 2002

(54) LOCKABLE DRILL STEEL AND CHUCK ASSEMBLY

(75) Inventors: Ted R. Massa, Latrobe; Gary J. Condon, Irwin; Daniel C. Statler, Waynesburg, all of PA (US)

(73) Assignee: Kennametal PC Inc., Monrovia, CA (US)

( * ) Notice: Subject to any disclaimer, the term of this patent is extended or adjusted under 35 U.S.C. 154(b) by 0 days.

(21) Appl. No.: 09/466,339

(22) Filed: Dec. 17, 1999

(51) Int. Cl.[7] ..... E21B 10/44; E21B 17/22; B23B 51/02

(52) U.S. Cl. ..... 175/323; 76/108.2; 76/108.6; 408/226

(58) Field of Search ..... 175/320, 323; 76/108.2, 108.6; 408/226

(56) References Cited

U.S. PATENT DOCUMENTS

| | | | | | |
|---|---|---|---|---|---|
| 2,733,943 | A | | 2/1956 | Nater | 287/125 |
| 3,893,353 | A | | 7/1975 | Lahmeyer | 76/108 T |
| 4,108,253 | A | | 8/1978 | Woodford, II | 173/23 |
| 4,117,894 | A | | 10/1978 | Saunders | 173/23 |
| 4,190,116 | A | | 2/1980 | O'Neal et al. | 173/38 |
| 4,226,290 | A | | 10/1980 | McSweeney | 175/320 |
| 4,311,347 | A | | 1/1982 | Cobb | 308/3.9 |
| 4,339,006 | A | | 7/1982 | Bower et al. | 175/57 |
| 4,454,922 | A | * | 6/1984 | Jamison et al. | 175/323 |
| 4,474,488 | A | | 10/1984 | Pinkerton et al. | 403/24 |
| 4,632,195 | A | | 12/1986 | Emmerich | 175/320 |
| 4,702,328 | A | | 10/1987 | McSweeney et al. | 175/320 |
| 4,773,490 | A | | 9/1988 | McSweeney et al. | 175/320 |
| 4,834,594 | A | | 5/1989 | Morgan | 408/239 |
| 5,325,931 | A | | 7/1994 | Woods | 175/257 |
| 5,337,842 | A | * | 8/1994 | Robinson | 175/323 |
| 5,400,861 | A | | 3/1995 | Sheirer | 175/427 |
| 5,494,382 | A | | 2/1996 | Kloppers | 408/226 |

* cited by examiner

*Primary Examiner*—David Bagnell
*Assistant Examiner*—Jennifer R. Dougherty
(74) *Attorney, Agent, or Firm*—Kevin P. Weldon; John J. Prizzi

(57) ABSTRACT

A drill steel-chuck assembly which includes a drill steel which has a plurality of faces and opposite ends. The drill steel has one portion adjacent one of the opposite ends thereof and a mediate portion spaced apart from the one portion. The drill steel further has one transition portion between the one portion and the mediate portion so as to join the one portion and the mediate portion. The one portion of the drill steel presents a first orientation of the faces. The mediate portion of the drill steel presents a second orientation of the faces. The one transition portion of the drill steel presents a twisted orientation of the faces comprising a generally constant twist of the faces from the first orientation of the one portion to the second orientation of the mediate portion. There is a chuck for attachment to the drill steel through engagement with the transition portion of the drill steel.

33 Claims, 11 Drawing Sheets

LOCKABLE DRILL STEEL AND CHUCK ASSEMBLY

FIELD OF THE INVENTION

The invention pertains to a drill steel and chuck assembly, as well as associated adapters, that are for use in drilling holes in the roof of an underground mine tunnel.

BACKGROUND OF THE INVENTION

The expansion of an underground mine (e.g.a coal mine) requires digging a tunnel which initially has an unsupported roof. To stabilize and support the roof a roof bolt must be inserted into the roof to provide support. The operator must first drill holes in the roof through the use of a rotatable cutting bit or roof drill bit. A roof bolt is then inserted into each one of the holes.

The roof drill bit is typically connected to the machine that rotates the bit by a drill steel. The drill steel is typically a hexagonally-shaped elongate rod. The roof drill bit connects to the drill steel at the distal (or upper) end thereof. The drill steel connects at the other end thereof to the machine that powers the roof drill bit. Sometimes these connections are made via chucks or some type of coupling.

In one instance, the drill steel (hexagonally-shaped) is inserted into a chuck with a hexagonally-shaped bore so as to provide torque to the roof drill bit, which is connected to the drill steel, for drilling the bolt holes. Upon completion of drilling the bolt hole using the above drill bit-chuck-drill steel assembly, the chuck is lowered from the ceiling and the drill bit and the drill steel normally follow under the influence of gravity. However, on occasion, the drill steel snags on the surface (of the earth strata) defining the bolt hole and does not fall out of the bolt hole under its own weight. The consequence of this occurrence is that the operator must manually remove the drill steel (and the roof drill bit) from the bolt hole. Because there is an increase in the automation of the bolt hole drilling operation, the operator is not always readily available to manually remove the drill steel from the bolt hole.

There are earlier lockable designs for a roof drilling system such as those disclosed in U.S. Pat. No. 4,773,490 to McSweeney et al., U.S. Pat. No. 4,702,290 to McSweeney et al., U.S. Pat. No. 4,632,195 to Emmerich et al., and U.S. Pat. No. 4,226,290 to McSweeney. These designs are, however, somewhat complex so that they are subject to malfunction and failure, especially in view of the severity of the operating environment.

It would be desirable to provide for a drill steel-chuck assembly (preferably of a simple design) in which these components are positively locked (or connected) together so that the drill steel can still be removed from the bolt hole even if it snags on the earth strata defining the bolt hole. It is also apparent that it would be desirable if such a drill steel-chuck assembly would be easily releasable (and connectable). It is further apparent that it would be desirable if such a drill steel-chuck assembly would provide for a positive driving connection between these components.

It is additionally apparent that it would be desirable if such a drill steel-chuck assembly would be compatible with existing equipment so that, for example, a drill steel of the invention would be compatible with an earlier chuck. Another example would be the use of an adapter to convert conventional straight drill steels to be suitable for use with the above-mentioned drill steels and/or chucks. By providing such an adapter, longer lengths of conventional straight drill steel could be cut to length and used with the above-mentioned drill steels and/or chucks. These features would permit an operator to have a mixed inventory of drill steels and chucks of the invention along with earlier drill steels and chucks.

SUMMARY OF THE INVENTION

In one form thereof, the invention is a drill steel-chuck assembly comprising a drill steel having a plurality of faces and opposite ends. The drill steel has one portion adjacent one of the opposite ends thereof and a mediate portion spaced apart from the one portion. The drill steel has one transition portion between the one portion and the mediate portion so as to join the one portion and the mediate portion. The one portion of the drill steel presents a first orientation of the faces. The mediate portion of the drill steel presents a second orientation of the faces. The one transition portion of the drill steel presents a twisted orientation of the faces comprising a generally constant twist of the faces from the first orientation of the one portion to the second orientation of the mediate portion. There is a chuck for attachment to the drill steel through engagement with the transition portion of the drill steel.

In another form thereof, the invention is a cutting bit assembly comprising a cutting bit and a drill steel which has a plurality of faces. The drill steel also has opposite ends. The cutting bit is in operative connection to the drill steel at one end thereof. The drill steel has one portion adjacent one of the opposite ends thereof and a mediate portion spaced apart from the one portion. The drill steel has one transition portion between the one portion and the mediate portion so as to join the one portion and the mediate portion. The one portion of the drill steel presents one orientation of the faces, and the mediate portion of the drill steel presents another orientation of the faces. The one transition portion of the drill steel presents a twisted orientation of the faces comprising a generally constant twist of the faces from the one orientation of the one portion to the other orientation of the mediate portion. A chuck attaches to the drill steel through engagement with the transition portion of the drill steel.

In still another form thereof, the invention is a drill steel-chuck assembly comprising a drill which has opposite ends wherein the drill steel presents a twisted portion adjacent to one of the ends. There is a chuck wherein the chuck contains a central bore which presents a twisted axial surface which corresponds to the twist of the twisted portion of the drill steel. The twisted portion of the drill steel is received in the central bore of the chuck so that the twisted portion of the drill steel contacts the twisted axial surface so as to form a secure attachment between the drill steel and the chuck.

In yet another form thereof, the invention is an adapter for use in connecting a pair of drill steels wherein the adjacent ends of the drill steels present a bore with a twisted portion. The adapter comprises an elongate body which has an upper end and a lower end. The elongate body presents a twisted upper portion adjacent to the upper end thereof and a lower twisted portion adjacent to the lower end thereof. The angle of twist of the upper twisted portion corresponds to the twist of the twisted portion of the bore in the drill steel so that when the upper twisted portion of the adapter engages the drill steel there is a secure attachment therebetween. The angle of twist of the lower twisted portion corresponding to the twist of the twisted portion of the bore in the drill steel so that when the lower twisted portion of the adapter engages the drill steel there is a secure attachment therebetween.

In another form thereof, the invention is an adapter for use in connecting a drill steel that has a substantially straight bore and another component that has a bore with a twisted portion. The adapter comprises an elongate body with opposite ends and a straight portion adjacent the one end thereof and a twisted portion adjacent to the other end of the elongate body. The angle of twist of the twisted portion of the elongate body corresponds to the angle of the central bore of the other component so that when the twisted portion of the adapter engages the other component there is a secure attachment between the adapter and the other component.

In another form thereof the invention is a drill steel that includes an elongate body that has an axially forward end and an axially rearward end. The elongate body contains a longitudinal bore presenting a twisted configuration wherein the twisted configuration exists along substantially the entire length of the longitudinal bore.

In still another form thereof, the invention is a drilling assembly that comprises a cutting bit and a drill steel. The drill steel has an elongate body with an axially forward end and an axially rearward end. The elongate body contains a longitudinal bore that presents a twisted configuration wherein the twisted configuration exists along substantially the entire length of the longitudinal bore. The cutting bit is operatively connected to the axially forward end of the drill steel.

BRIEF DESCRIPTION OF THE DRAWINGS

The following is a brief description of the drawings that form a part of this patent application.

DETAILED DESCRIPTION OF THE INVENTION

Figure 1:
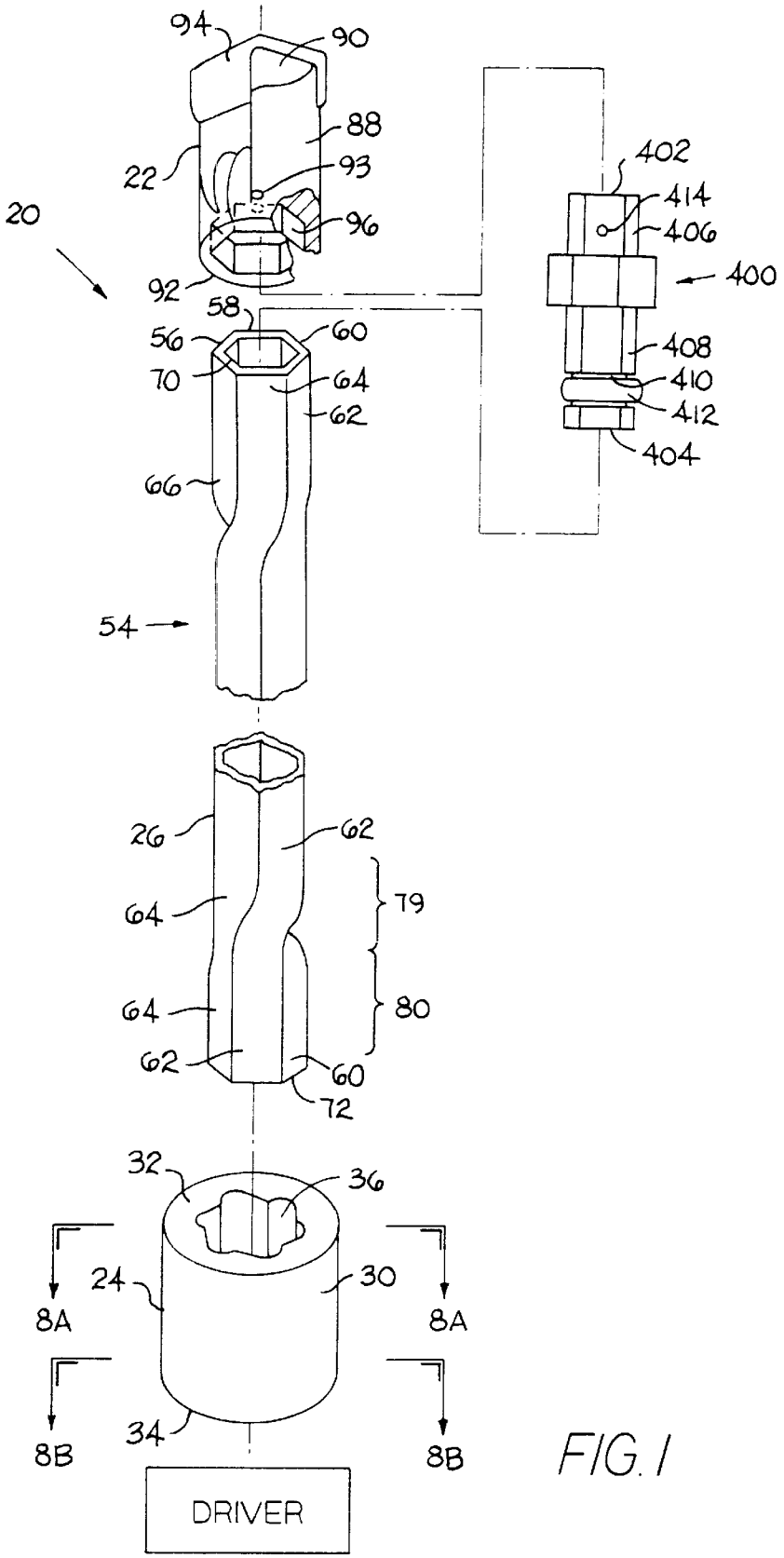
FIG. 1 is an isometric view of a specific embodiment of a drill steel-chuck assembly along with a roof drill bit and an adapter near the distal end of the drill steel and a chuck at the opposite end of the drill steel and wherein the components are exploded apart from one another.

Referring to the drawings, FIG. 1 illustrates a specific embodiment of a roof drill bit-drill steel-chuck assembly generally designated as 20. The drill steel-chuck assembly 20 includes a roof drill bit 22 (i.e., a cutting bit), a chuck 24, and a drill steel 26.

Figure 6:
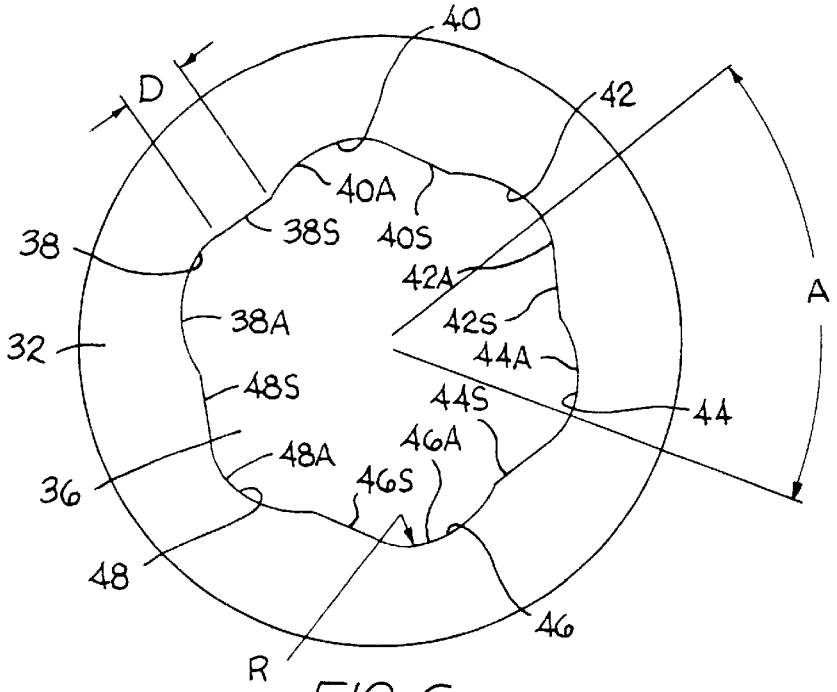
FIG. 6 is a top view of the chuck showing the configuration of the scalloped central bore at the upper opening of the chuck.

Referring to the chuck 24, it comprises a generally cylindrical body 30 having opposite ends (32, 34). The cylindrical body 30 contains a central bore 36 wherein the bore 36 is defined by six equi-spaced lobes (38, 40, 42, 44, 46, 48) [see FIG. 6]. Referring to FIG. 6, each lobe is spaced apart from its adjacent lobe by an angle "A". In the specific embodiment angle "A" equals sixty degrees since there are six lobes. Each lobe has two surfaces; namely, an arcuate surface (38A, 40A, 42A, 44A, 46A, 48A) and a straight surface (38S, 40S, 42S, 44S, 46S, 48S). Each arcuate surface has a radius "R" wherein the arcuate surface 46A illustrates the radius "R". Each straight surface has a length "D" wherein the straight surface 38S illustrates the length "D".

Figure 7:
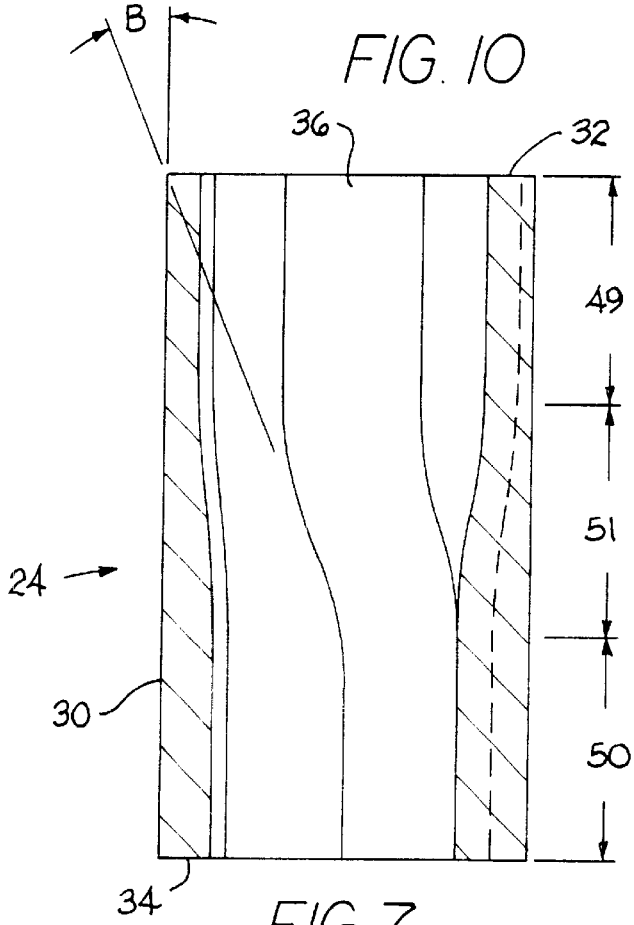
FIG. 7 is a cross-sectional view of the chuck showing the configuration of the central bore of the chuck along its entire length.
Figure 8A:
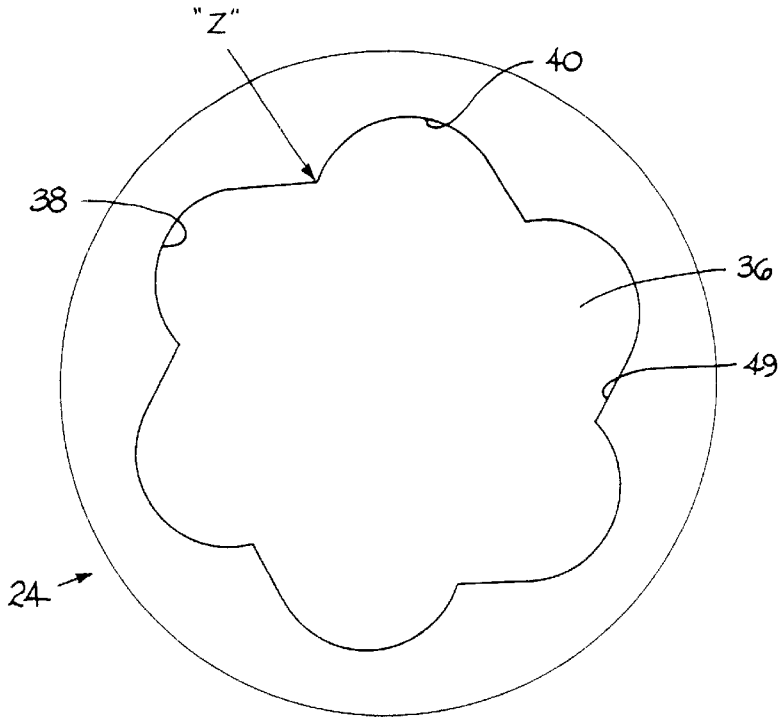
FIG. 8A is a cross-sectional view of the chuck taken along section line 8A—8A of FIG. 1.
Figure 8B:
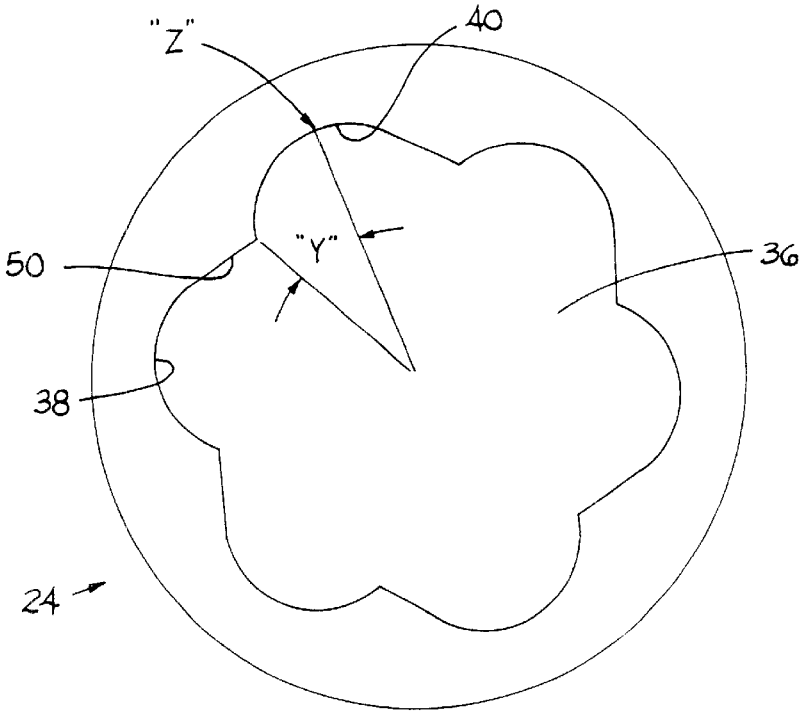
FIG. 8B is a cross-sectional view of the chuck taken along section line 8B—8B of FIG. 1.

Referring to FIGS. 7, 8A and 8B, the central bore 36 of the chuck 24 has an upper section 49 and a lower section 50. The upper section 49 and the lower section 50 are disposed about twenty-six degrees apart in that the lobes are rotated relative to each other about twenty-six degrees counter to the direction of rotation. The relative positioning of the lobes is shown by the cross-sectional views of FIGS. 8A and 8B. FIG. 8A shows the orientation of the lobes in the top section 49 of the chuck 24. FIG. 8B shows the orientation of the lobes in the lower section 50. As can be seen from these drawings, the lobes are rotated counter to the direction of rotation. Reference point "Z" remains at the same point in space for both FIGS. 8A and 8B. In FIG. 8A reference point "Z" is shown as being at the point of joinder between lobes 38 and 40, and in FIG. 8B reference point "Z" is shown as being along the edge of lobe 40. The relative rotation between the lobes of the upper section 49 and the lower section 50 is shown by the different position of the lobes relative to the fixed reference point "Z". The extent of the movement is angle "Y" (see FIG. 8B). Angle "Y" preferably is about twenty-seven degrees, but it may range between about zero degrees and about sixty degrees, and more preferably, it may range between about five degrees an about forty-five degrees, depending upon the application.

To provide for the transition between the lobes of the upper section 49 and the lobes of the lower section 50 there is a so-called "twisted" mediate section 51 of the central bore 36. In the mediate section 51 to lobes are twisted at an angle of twist "B" (see FIG. 7) equal to about twelve degrees in a continuous consistent fashion. It should be appreciated that the transition between the upper section 49 and the lower section 51, as well as the transition between the lower section 50 and the mediate section 51, is not abrupt, but is instead accomplished due to a small radius. Although the specific angle of twist "B" is about twelve degrees, it should be appreciated that this angle may vary between about zero degrees and about twenty-six degrees depending upon the specific application. In a narrower range, the angle of twist "B" may range between about five degrees and about fifteen degrees depending upon the specific application.

Figure 2:
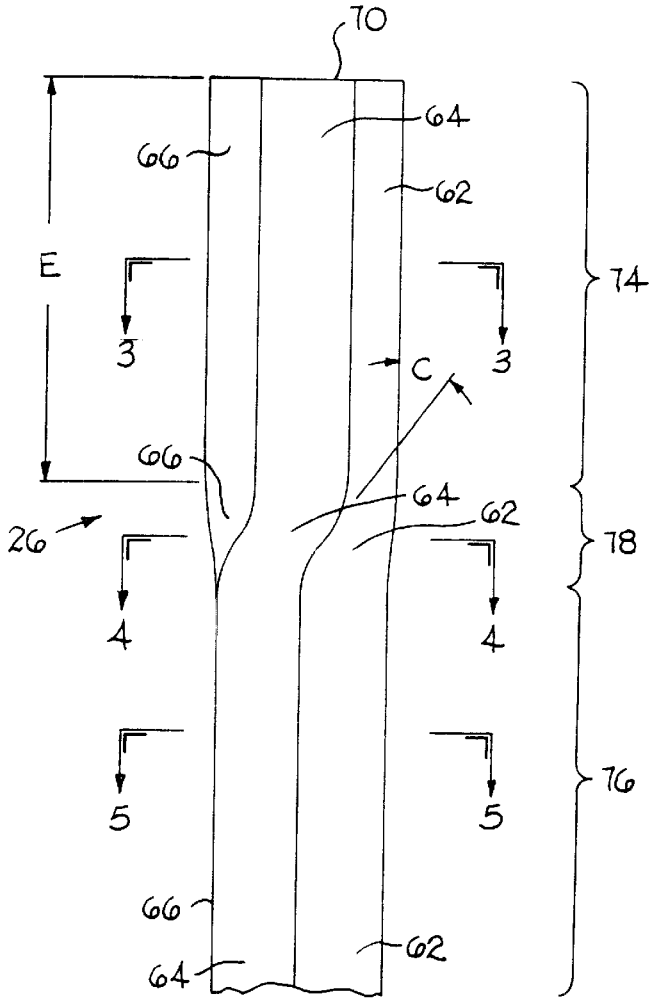
FIG. 2 is a side view of the portion of the drill steel of FIG. 1 adjacent to the distal end of the drill steel.

Referring to the depiction of the drill steel and in particular to the depiction of the drill steel in FIGS. 1 and 2, the drill steel 26 has an elongate body 54 which presents six equi-spaced generally planar surfaces (56, 58, 60, 62, 64, 66). Drill steel 54 further includes opposite ends (70, 72) wherein the distal end 70 connects to the drill bit via an adapter 400 as will be discussed hereinafter and the other end 72 connects to the chuck 24 that connects the drill steel to the machine that rotates the drill bit-drill steel-chuck assembly (which is illustrated in mechanical schematic in FIG. 1 as the "DRIVER").

Referring to FIG. 2, there is illustrated the distal section of the drill steel 26 adjacent to the distal end 70 thereof. The distal section of the drill steel 54 has an upper section 74 (see the brackets in FIG. 2), a lower section 76 (see the brackets in FIG. 2), and a so-called "twisted" mediate section 78 (see the brackets in FIG. 2). The upper section 74 is adjacent to the distal end 70 of the drill steel 26. The mediate section 78 is contiguous with and axially rearward of the upper section 74. The lower section 76 is contiguous with and axially rearward of the mediate section 78. It should be appreciated that the lower section 76 essentially is the intermediate section of the drill steel and is contiguous with a twisted section 79 (see FIG. 1) near the other end 72 of the drill steel. The twisted section 79 separates the intermediate section of the drill steel from a lower section 80 (see the brackets in FIG. 1) of the drill steel. The lower section 80 of the drill steel 26 is received into the central bore 36 of the chuck 24 as will be described hereinafter.

The upper section 74 has an orientation such that the surfaces 62, 64 and 66 face outward from the drawing. One may consider for the purpose of this description that this orientation is in a starting or neutral position. The upper section 74 may be considered to be straight in that it does not present any twist or helical configuration.

Figure 3:
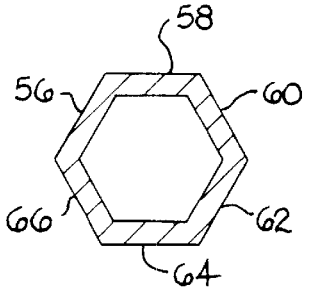
FIG. 3 is a cross-sectional view of the drill steel of FIG. 2 taken along section line 3—3 of FIG. 2.
Figure 4:
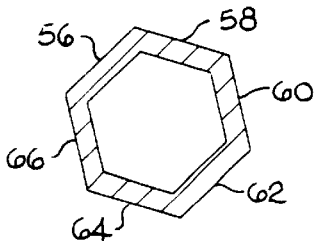
FIG. 4 is a cross-sectional view of the drill steel of FIG. 2 taken along section line 4—4 of FIG. 2.
Figure 5:
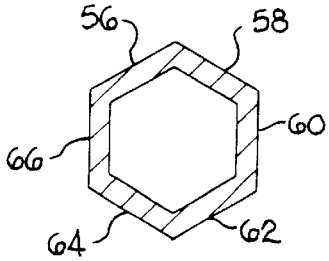
FIG. 5 is a cross-sectional view of the drill steel of FIG. 2 taken along section line 5—5 of FIG. 2.

The mediate section 78 comprises a continuous gradual twist (or rotation) of the drill steel surfaces from its joinder with the upper section 74 to its joinder with the lower section 76 so that the lower section 76 presents surfaces 62 and 64. The "twist" is consistent along the length of the mediate section so that the presentation of the surface 66 gradually decreases as the mediate section moves toward the lower section. The angle of twist "C" is about twelve degrees as is shown in FIG. 2. The twist moves in the clockwise direction as viewed in FIGS. 3 through 5. Typically, the "twist" begins to occur at a point about two inches (5.08 centimeters) from the distal end 70 of the drill steel wherein this distance is shown as dimension "E" in FIG. 2. The configuration of the twist may vary depending upon the specific application for the assembly; however, it is anticipated that the angle of twist "C" will range between about zero degrees and about twenty-six degrees. A narrower range for angle "C" is between about five degrees and about fifteen degrees.

It should be appreciated that even though the drill steel 26 has a twisted section (78, 79) near each one of the opposite ends (70, 72) thereof, applicants do not intend to limit the invention to requiring a twisted portion at each end of the drill steel. Applicants contemplate that the invention encompasses a drill steel in which a twisted portion is near only one end of the drill steel and the other end of the drill steel is straight.

The assembly illustrated in FIG. 1 also includes an adapter generally designated as 400. Adapter 400 has an axially forward end 402 and a axially rearward end 404. The adapter 400 has an axially forward portion 406 that is adjacent to the axially forward end 402, and an axially rearward portion 406 that is adjacent to the axially rearward end 404. The axially forward portion 406, as well as the axially rearward portion 408, each presents a hexagonal surface. The hexagonal surface of the axially rearward portion 408 corresponds to the hexagonal surface of the bore of the drill steel 54 adjacent to the distal end 70 thereof. The axially rearward portion 408 of the adapter 400 contains a channel 410 that carries a resilient ring 412. The axially forward portion 406 carries a spring-biased detent 414.

The assembly shown in FIG. 1 further includes a roof drill bit (i.e., a rotatable cutting bit) 22. Roof drill bit 22 has an elongate body 88 which has opposite ends 90, 92. The elongate body 88 also contains an aperture 93 in the side wall thereof. A hard insert 94 is at the one end 90 of the drill bit body 88. The roof drill bit has a central bore 96 which is defined by a hexagonal surface. The hexagonal surface corresponds to the hexagonal surface presented by the axially forward portion 406 of the adapter 400.

To use the assembly, the axially forward portion 406 of the adapter 400 is received within the bore of the roof drill bit 22. When the roof drill bit 22 and the adapter 400 are securely affixed together, the detent 414 is received within the aperture 93. An exemplary connection between a roof drill bit and a drill steel is shown in U.S. Pat. No. 5,400,861 to Sheirer for a ROTATABLE CUTTING BIT ASSEMBLY (assigned to Kennametal Inc. [the assignee of the instant invention]) and this patent is hereby incorporated by reference herein.

The axially rearward portion 408 of the adapter 400 is received within the bore of the drill steel 54 at the distal end 70 of the drill steel 26. When the axially rearward portion 408 is within the bore of the drill steel 54 the resilient ring 412 expands against the wall of the bore so as to frictionally engage the bore wall and assist in the connection of the adapter 400 to the drill steel 54.

Figure 9:
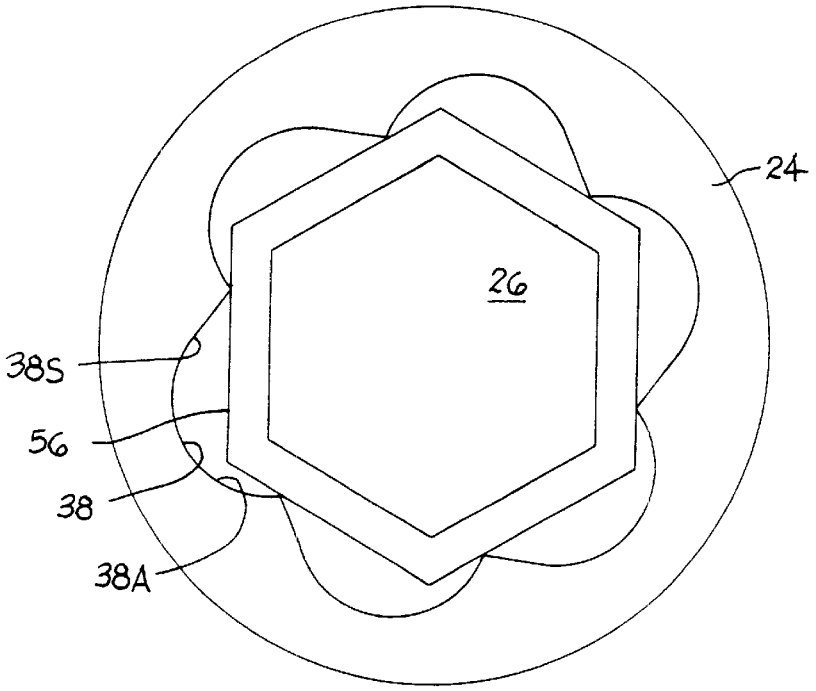
FIG. 9 is a mechanical schematic view showing the relationship between the surfaces of the hexagonal drill steel and the surfaces of the central bore of the chuck when the drill steel is first inserted into the central bore of the chuck.

To assemble the drill steel 26 to the chuck 24, the drill steel 26 is inserted into the lobed central bore 36 of the chuck 24 until the walls of the central lobed bore first come into contact with the surfaces of the drill steel. This relationship is shown in a mechanical schematic fashion in FIG. 9. In this position a portion of each surface of the drill steel (e.g., surface 56 of the drill steel) is proximate to the arcuate portion (e.g., arcuate portion 38A of the lobe 38) of its corresponding lobe. However, there is not a positive driving relationship between the drill steel 26 and the chuck 24 when these structural elements are in this position.

Figure 10:
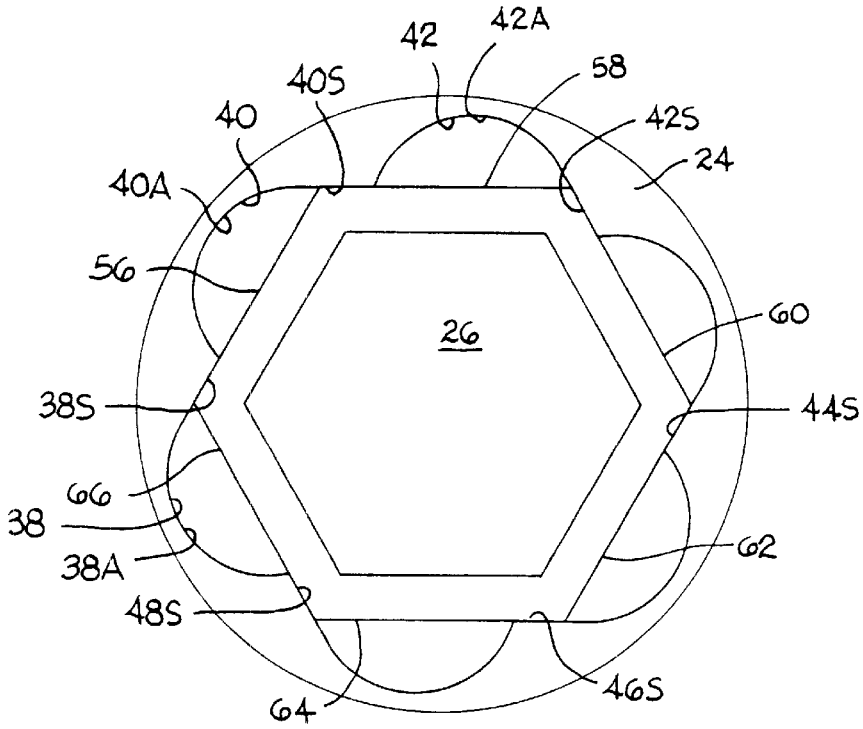
FIG. 10 is a mechanical schematic view showing the relationship between the surfaces of the hexagonal drill steel and the surfaces of the central bore of the chuck after the chuck has been rotated so as to form a positive driving relationship between the chuck and the drill steel.

To place the drill steel 26 and the chuck 24 in a positive driving relationship, the chuck 24 is twisted relative to the drill steel 26 in the direction of operational rotation of the assembly so that a portion of the surface of each hexagonal surface is in direct contact with the straight portion of its corresponding lobe. This relationship is shown in FIG. 10.

When in this position there is a positive driving relationship between the drill steel 26 and the chuck 24. In addition, when in this position the chuck 24 and drill steel 26 are locked together so that if during exit from the hole the drill steel 26 snags the earth strata defining the hole, the chuck 24 and drill steel 26 will still remain connected together so that the drill steel does not become disconnected from the chuck.

In order to disconnect the chuck 24 from the drill steel 26, the operator only has to twist the chuck 24 relative to the drill steel 26 in the opposite direction to the direction of rotation thereby disengaging the positive driving relationship, as well as the locking relationship, between these components. The ability to maintain the attachment between the drill steel and the chuck (and thus avoid the drill steel becoming disconnected from the chuck and being stuck in the hole), and the ability to easily disconnect the chuck from the drill steel provide significant advantages as described above.

Figure 11:
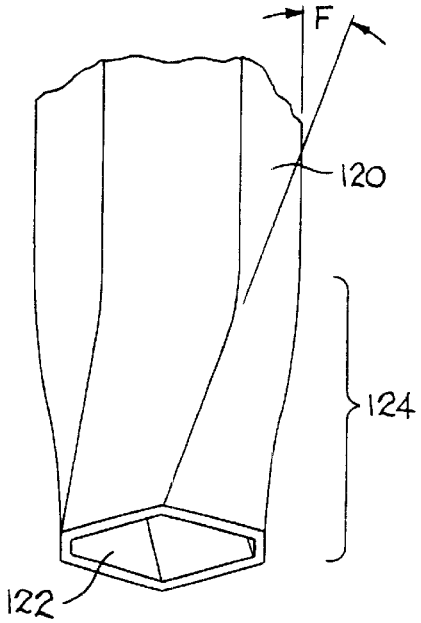
FIG. 11 is an isometric view of another specific embodiment of a hexagonal drill steel showing the configuration of the lower end of the drill steel.
Figure 12:
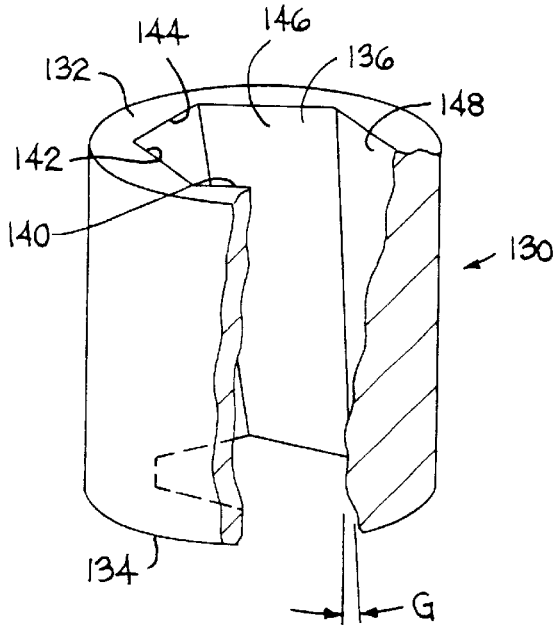
FIG. 12 is an isometric view of another specific embodiment of a chuck which functions in cooperation with the hexagonal drill steel illustrated in FIG. 11 and wherein a portion of the wall of the chuck is cut away so as to show the configuration of the central bore of the chuck.

Another specific embodiment is illustrated in FIGS. 11 and 12. Referring to FIGS. 11–12, there is illustrated a hexagonal drill steel 120 which has an upper end (not illustrated) and a lower end 122 that presents a twist. It should be appreciated that the upper end may contain a twist like the lower end 122 of the drill steel. In the alternative, the upper end of the drill steel may be straight in that it does not present a twist like the lower end 122.

The drill steel 120 presents a straight hexagonal geometry along most all of its length, except (as briefly described above) near the lower end 122 thereof. At the lower end 122 of the drill steel 120 there is a twisted (or helical) portion 124 (shown by the brackets in FIG. 11) wherein the surfaces of the drill steel 120 are rotated or twisted at an angle of twist "F" equal to about twelve degrees. The twisted portion 124 of the drill steel 120 terminates at the lower end 122 thereof. Angle of twist "F" may vary between about zero degrees to about forty-five degrees depending upon the specific application, and may preferably vary between about five degrees and about twenty degrees.

The specific embodiment referred to in FIGS. 11–12 further includes a chuck 130. Chuck 130 has an upper end 132 and a lower end 134. The chuck 130 contains a central bore 136 which presents a hexagonal surface with six surfaces (140, 142, 144, 146, 148 [the sixth surface is not illustrated]). These surfaces are twisted at an angle of twist "G" equal to about twelve degrees so as to correspond to the configuration of twist in the twisted portion 124 (see FIG. 11) of the drill steel 120. The central bore 136 of the chuck 130 presents a twist that extends along the entire length of the bore 136 so as to extend from the upper end 132 to the lower end 134 of the chuck 130. It should be appreciated that the angle of twist "G" can range between about zero degrees and about forty-five degrees, and may more preferably vary between about five degrees and about twenty degrees, depending upon the specific application.

In regard to the assembly of the chuck 130 to the drill steel 120, the twisted portion 124 of the drill steel is inserted into the central bore 136 of the chuck 130. The correspondence between the twist of the central bore 136 and the twisted portion 124 of the drill steel will create a positive driving relationship between the drill steel 120 and the chuck 130. The presence of the twist will prevent the drill steel 120 from becoming disconnected from the chuck 130 if the drill steel 120 (or cutting bit connected thereto) becomes snagged on the earth strata during the removal of the drilling apparatus from the hole.

It can thus be appreciated that the specific embodiment of FIGS. 11 and 12 provides for a structurally simple, and yet effective, connection between the drill steel and the chuck. The connection will effectively maintain the positive driving relationship between the drill steel and the chuck during operation. The connection will also prevent the disconnection of the drill steel from the chuck in the event the drill steel (or cutting bit) becomes snagged (or engages) the earth strata during the removal of the drilling assembly from the hole. The connection also provides for the easy and quick connection or disconnection of the drill steel to or from the chuck by the operator.

Figure 13:
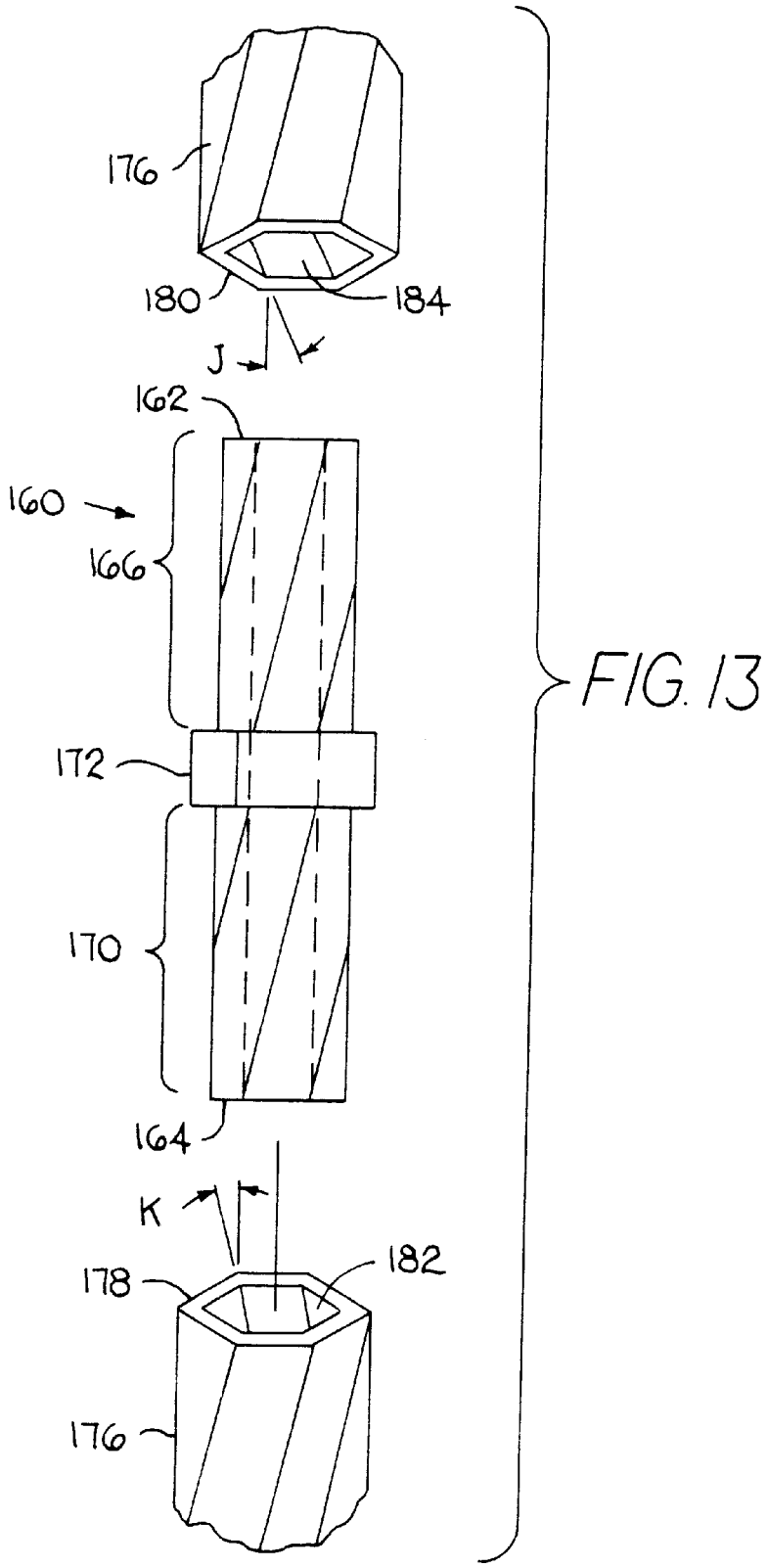
FIG. 13 is an isometric view of a specific embodiment of an adapter to be used in conjunction with a pair of drill steels so as to connect the drill steels together and wherein each drill steel is exploded away from its respective opposite end of the adapter.

The specific embodiment of FIGS. 11 through 13 further includes an adapter generally designated as 160. The adapter 160 has an upper end 162 and an opposite lower end 164. The adapter 160 has an upper twisted portion 166 which is adjacent to the upper end 162 thereof. The upper twisted portion 166 presents a hexagonal surface that is twisted at an angle of twist "H" (see FIG. 14) equal to about twelve degrees along the length thereof wherein the configuration of the twist corresponds to the configuration of the bore 184 of the drill steel 176.

The adapter 160 has a lower twisted portion 170 which is adjacent to the lower end 164 thereof. The lower twisted portion 170 presents a hexagonal surface that is twisted at an angle of twist "I" equal to about twelve degrees along the length thereof wherein the configuration of the twist corresponds to the twist of the central bore 182 of the drill steel 176.

Typically, the angle of twist "H" and the angle of twist "I" each equal about twelve degrees. It is possible for certain applications that these angles, i.e., "H" and "I", may be different. Angles of twist "H" and "I" may range between about zero degrees and about forty-five degrees, and more preferably may range between about five degrees and about twenty degrees.

A collar 172 separates the upper twisted portion 166 from the lower twisted portion 170. The collar 172 presents a hexagonal surface.

The adapter 160 is intended to function in cooperation with a pair of drill steels 176. Each drill steel 176 has opposite upper end 178 and a lower end 180. These upper and lower ends (178, 180) each present a bore (182, 184, respectively) which presents a twisted surface so as to correspond to the twisted portions (166, 170) of the adapter 160. More specifically, bore 182 presents a twist at an angle of twist "J" and bore 184 presents a twist at an angle of twist "K". Angle "J" equals about twelve degrees and angle "K" equals about twelve degrees. Angles "J" and "K" may range between about zero degrees and about forty-five degrees, and more preferably may range between about five degrees and about twenty degrees depending upon the application.

In use, the drill steel 176 near the upper end 162 of the adapter 160 receives the upper twisted portion 166 so that the surfaces that define the bore 184 contact (and engage) the surfaces that define upper twisted portion 166. There is a positive driving relationship between the drill steel 176 and the adapter 160 via the connection between the upper twisted portion 166 and the upper drill steel 176. The connection between the drill steel 176 near the lower end 164 of the adapter 160 is like that for the drill steel 176 near the upper end of the adapter 160. In other words, the surfaces that define the bore 182 of the lower drill steel 176 contact the surfaces of the lower twisted portion 170 of the adapter 160 so as to create a positive driving relationship therebetween.

The use of the adapter 160 with the drill steels 176 will permit the detachable connection of a plurality of drill steels 176 so as to accommodate a variety of lengths (of drill steels) necessary for drilling. This connection is secure due to the twist in that the drill steels will not become disconnected from the adapter if the drill steels snag the earth strata upon removal of the drilling assembly from the hole. This connection is simple in that the geometry of the elements is simple and thus less susceptible to failure because of the severe operating environment than would an apparatus having a structurally complex connection.

It is not unusual that conventional drill steel is produced in twelve foot lengths. In the drilling operation, the operator typically prefers to use as few as drill steels as possible. In mines that are not tall, e.g., a mine shaft having a height of thirty inches, it is necessary to cut the longer lengths of drill steel into shorter lengths. In order to be able to use these shorter length drill steels cut-to-size from a longer length drill steel along with the drill steels and chucks of the present invention, applicants provide a number of specific embodiments of adapters wherein each one of these adapters typically connects together a conventional drill steel with either a drill steel having a twisted portion or a chuck having a bore with a twisted portion.

Figure 16:
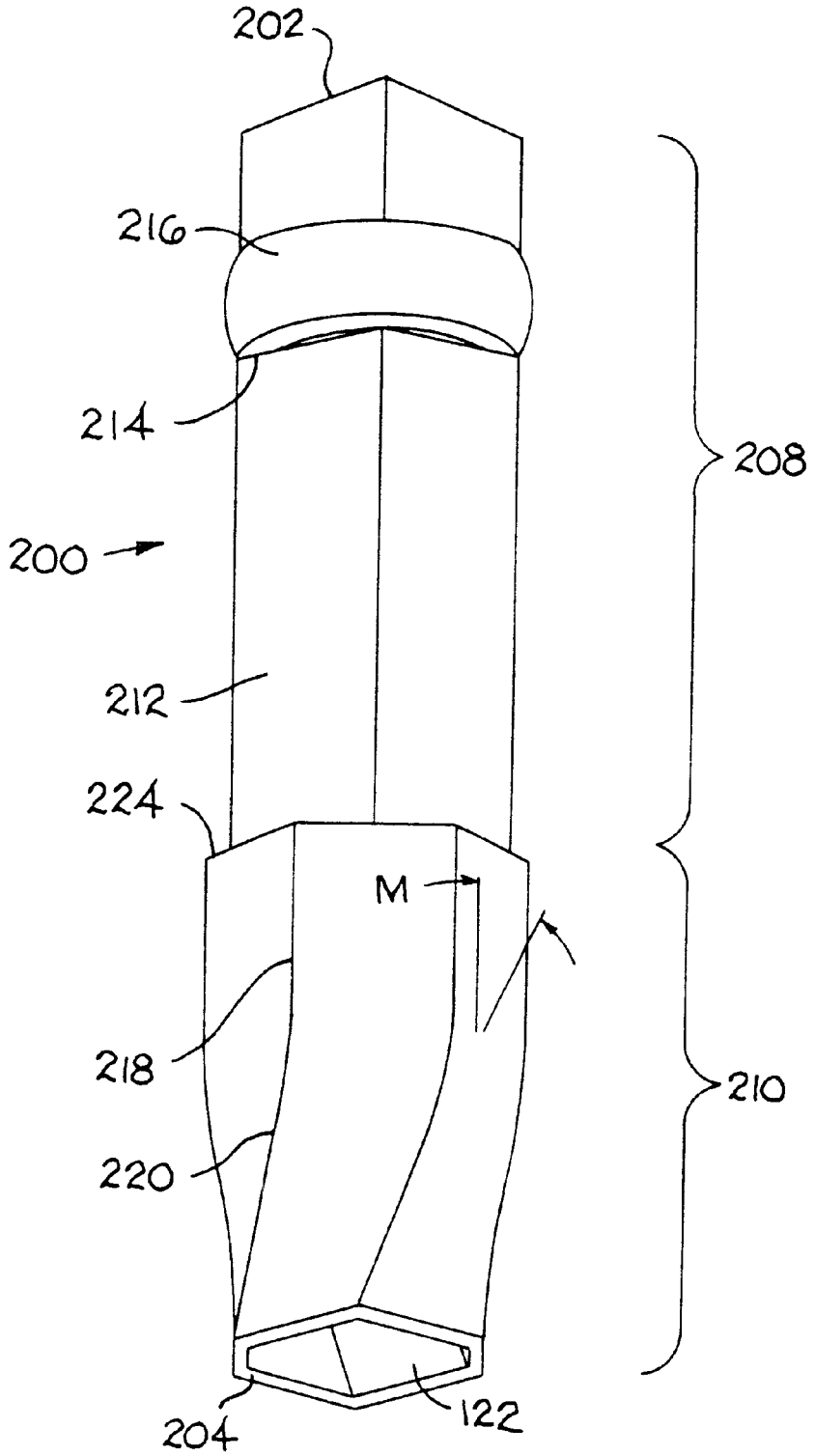
FIG. 16 is a side view of another embodiment of an adapter that joins a straight hexagonal drill steel to a drill steel with a twisted portion.

FIG. 16 illustrates an adapter generally designated as 200. Although adapter 200 is not illustrated along with other components, it should be appreciated that adapter 200 is typically used to join together a straight hexagonal drill steel and a chuck structurally the same as the chuck 130 illustrated in FIG. 12 hereof.

Referring to the adapter 200, it has opposite ends 202 and 204 wherein there is a straight hexagonal portion 208 adjacent to the one end 202 and a generally twisted hexagonal portion 210 adjacent to the other end 204. The straight hexagonal portion 208 has a six equi-spaced external surfaces 212 so as to define the hexagonal surface. The straight hexagonal portion 208 also contains a groove 214 near the one end 202 of the adapter 200. A resilient retainer ring 216 is kept captive in the groove 214.

The straight hexagonal portion 208 is intended to be received within the bore of a straight hexagonal drill steel. When the straight hexagonal portion 208 is received within the bore of the straight drill steel, the resilient ring 216 is compressed so as to expand radially outwardly against the wall of the bore of the straight hexagonal drill steel thereby frictionally engaging the same. This frictional engagement helps maintain the connection between the drill steel and the adapter 200. The distal end of the conventional straight drill steel typically abuts against the shoulder 224 of the adapter 200.

The generally twisted portion 210 of the adapter 200 preferably presents an upper straight section 218 that begins at and extends downwardly away from the shoulder 224. The upper straight section 218 changes to a lower twisted section 220 wherein the lower twisted section 220 continues on for the remainder of the length of the twisted portion 210 of the adapter 200. Although the generally twisted portion 210 has an upper straight section as described above, it should be appreciated that this twisted portion 210 may have a configuration so as to exhibit a twist along its entire axial length. In other words, the generally twisted portion may have a twisted configuration that extends from the junction with the shoulder 224 to the distal end thereof.

The adapter 200 contains a bore 222 that presents a twisted configuration corresponding to the lower twisted section 220 and a straight configuration for the balance of the bore corresponding to the straight hexagonal portion 208. The angle of twist "M" for the twisted configuration of the bore 222 equals about twelve degrees. This angle of twist "M" may, however, range between about zero degrees and about forty-five degrees with a more preferably range being between about five degrees and about twenty degrees, depending upon the specific application for the adapter 200.

As previously mentioned, the twisted portion 210 of the adapter 200 may engage a chuck structurally the same as the chuck illustrated in, and described in connection with, FIG. 12 hereof. The chuck contains a central bore which presents a hexagonal surface with six surfaces wherein these surfaces are twisted at an angle of twist equal to about twelve degrees so as to correspond to the configuration of twist in the bore of the twisted portion 210 of the adapter 200. The central bore of the chuck presents a twist that extends along the entire length of the bore. For the central bore of the chuck, this angle of twist can range between about zero degrees and about forty-five degrees, and may more preferably vary between about five degrees and about twenty degrees, depending upon the specific application.

In regard to the assembly of the chuck to the adapter 200, the twisted portion 210 of the adapter 200 is inserted into the central bore of the chuck. The correspondence between the twist of the central bore and the twisted portion of the adapter 200 will create a positive driving relationship between the adapter 200 and the chuck. The presence of the twist will prevent the adapter 200 from becoming disconnected from the chuck if the adapter (or the drill steel which is a part of the assembly including the cutting bit connected to the drill steel) becomes snagged on the earth strata during the removal of the drilling apparatus from the hole. By providing the adapter 200, applicants allow the operator to use a conventional drill steel cut to any length along with the chuck (e.g., chuck 130) to obtain the above-recited advantages.

Figure 17:
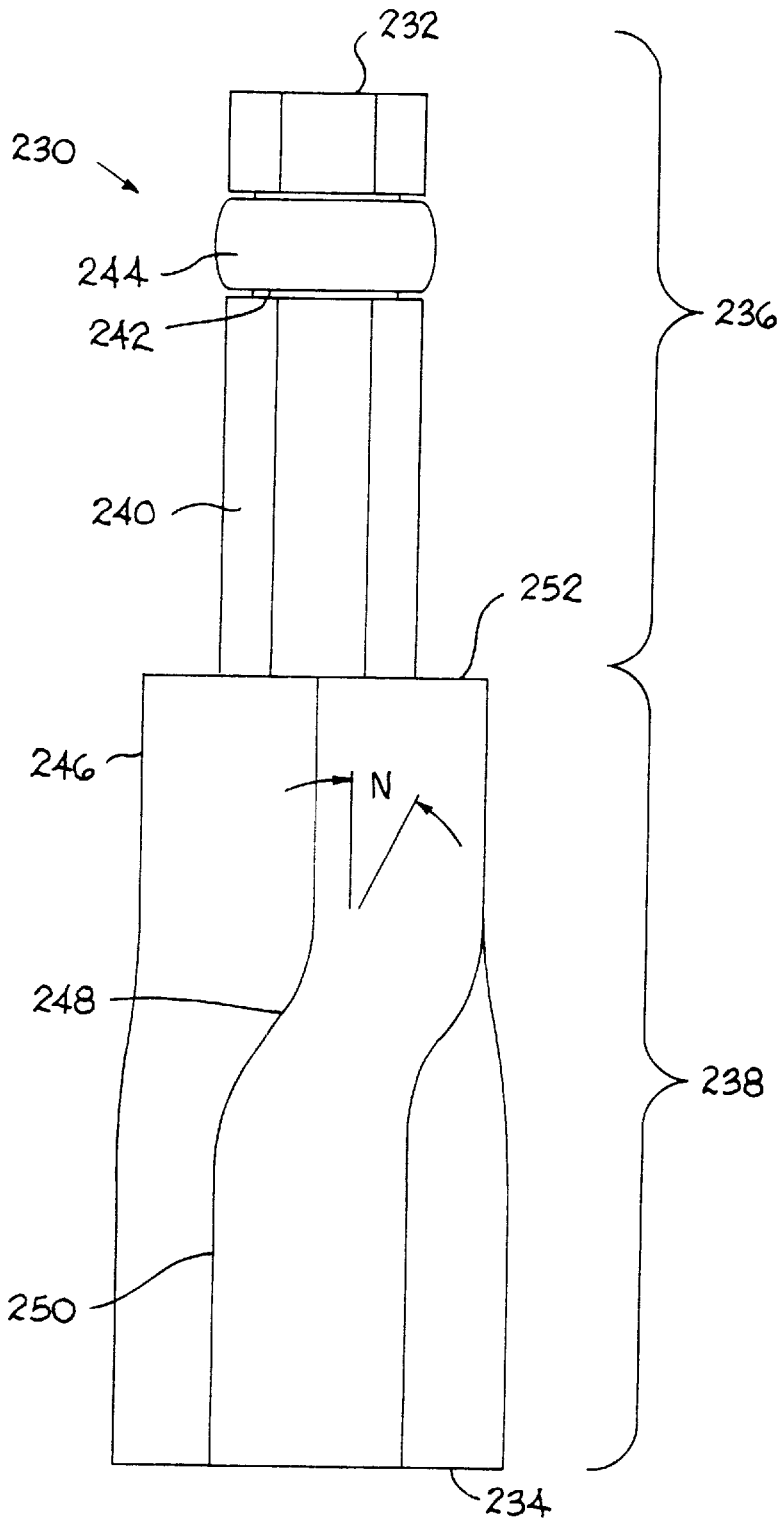
FIG. 17 is a side view of still another specific embodiment of an adapter that joins a straight hexagonal drill steel to a chuck.

FIG. 17 illustrates another specific embodiment of an adapter generally designated as 230. Although adapter 230 is not illustrated along with other components, it should be appreciated that adapter 230 is typically used to connect together a straight hexagonal drill steel and a chuck structurally the same as chuck 24 illustrated in FIGS. 1, 6, 7, 8A and 8B.

Referring to the adapter 230, it has opposite ends 232 and 234 wherein there is a straight hexagonal portion 236 adjacent to the one end 232 and a twisted hexagonal portion 238 adjacent to the other end 234. The straight portion 236 presents six external surfaces 240 that define the hexagonal surface. The straight portion 236 also contains a groove 242 that carries resilient retainer ring 244 so that the retainer ring 244 is captive within the groove 242.

Like for the adapter 200, the straight hexagonal portion 236 is intended to be received within the bore of a straight hexagonal drill steel. The interaction between the straight hexagonal portion 236 and the bore of the straight hexagonal drill steel is the same as the interaction between the straight hahexagonal portion 208 and the bore of the straight hexagonal drill steel.

The twisted hexagonal portion 238 presents three distinct sections; namely, a upper straight section 246, a mediate twisted section 248, and a lower straight section 250. There is a shoulder 252 at the juncture between the upper straight portion 236 and the lower twisted portion 238.

The first straight section 246 begins at and extends away from the shoulder 252. The upper straight section 246 turns into the mediate twisted section 248 which extends a distance along the length of the twisted portion 238. The mediate twisted section 248 then turns into the lower straight section 250 which extends to the other end 234 of the adapter 230.

The mediate twisted portion 238 is disposed at an angle of twist "N" that equals about twelve degrees. This angle of twist "N" may, however, range between about zero degrees and about twenty-six degrees with a more preferably range being between about five degrees and about fifteen degrees, depending upon the specific application for the adapter.

To assemble the adapter 230 to a chuck like the chuck shown in, and described in connection with, FIGS. 1, 6, 7, 8A and 8B the adapter 230 is inserted into the lobed central bore of the chuck until the walls of the central lobed bore first come into contact with the surfaces of the adapter 230. In this position a portion of each surface of the twisted portion of the adapter 230 is proximate to the arcuate portion of its corresponding lobe. However, there is not a positive driving relationship between the adapter 230 and the chuck when these structural elements are in this position.

To place the adapter 230 and the chuck in a positive driving relationship, the chuck is twisted relative to the adapter 230 in the direction of operational rotation of the assembly so that a portion of the surface of each hexagonal surface is in direct contact with the straight portion of its corresponding lobe. When in this position there is a positive driving relationship between the adapter 230 and the chuck. In addition, when in this position the chuck and adapter 230 are locked together so that if during exit from the hole the adapter (or the drill steel and/or cutting bit that is a part of the assembly) snags the earth strata defining the hole, the chuck and adapter 230 will still remain connected together so that the adapter (and other components) does not become disconnected from the chuck.

In order to disconnect the chuck from the adapter 230, the operator only has to twist the chuck relative to the adapter 230 in the opposite direction to the direction of rotation thereby disengaging the positive driving relationship, as well as the locking relationship, between these components. The ability to maintain the attachment between the adapter and the chuck (and thus avoid the adapter and other components becoming disconnected from the chuck and being stuck in the hole), and the ability to easily disconnect the chuck from the adapter provide significant advantages as described above.

Figure 18:
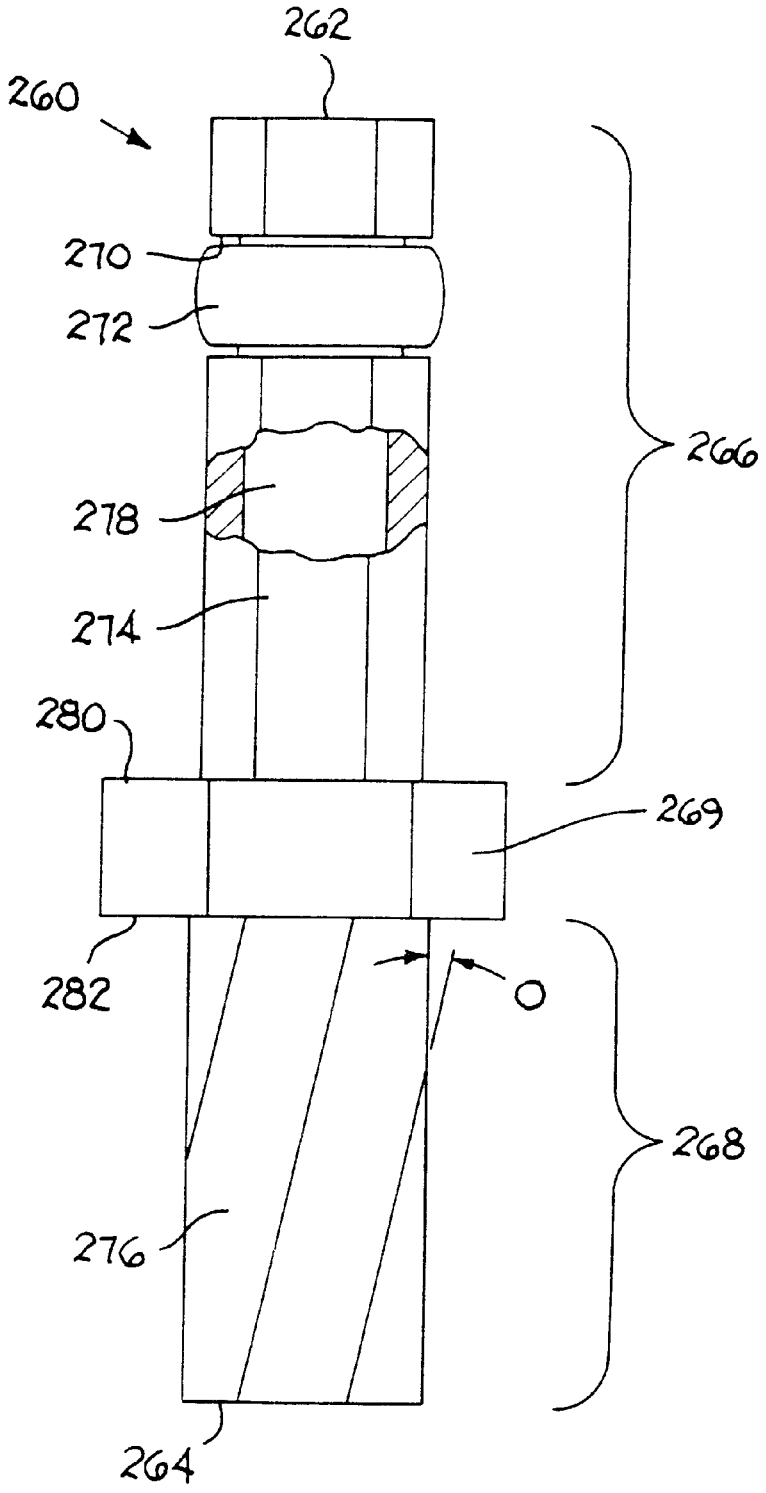
FIG. 18 is a side view of yet another specific embodiment of an adapter that joins a pair of drill steels wherein one drill steel is a straight hexagonal drill steel and the other drill steel contains a twisted portion, and the drawing showing a portion of the adapter cut away to expose the longitudinal bore.

FIG. 18 illustrates yet another specific embodiment of an adapter generally designated as 260. The adapter 260 is intended to function in cooperation with a pair of drill steels wherein one of the drill steels is a conventional straight drill steel that presents a straight hexagonal bore. The other drill steel presents a bore that has a twisted surface so as to correspond to the twisted portions of the adapter 260.

Adapter 260 has opposite ends 262 and 264. Adapter 260 has a straight hexagonal portion 266 adjacent the one end 262 and a twisted hexagonal portion 268 adjacent the other end 268. There is a hexagonal collar 269 between the straight portion 266 and the twisted portion 268.

The straight portion 266 contains a groove 270 that carries a resilient retainer ring 272 so that the ring 272 is captive in the groove 270. The straight portion 266 presents six equi-spaced external surfaces 274 so as to define a hexagonal surface.

The twisted portion 268 presents six equi-spaced surfaces 276 which are disposed at an angle of twist "O". The angle of twist "O" equals about twelve degrees. This angle of twist "O" may, however, range between about zero degrees and about forty-five degrees with a more preferably range being between about five degrees and about twenty degrees, depending upon the specific application for the adapter.

The adapter 260 contains a longitudinal hexagonal bore 278 that extends the length of the adapter 260. The collar 269 presents one shoulder 280 that faces toward the one end 262 of the adapter 260. The collar 269 presents another shoulder 282 that faces toward the other end 264 of the adapter 260.

Referring to the assembly of the drill steels and the adapter 260, the conventional straight bore drill steel receives the upper straight portion 266 of the adapter 260 so that the surfaces that define the bore contact (and engage) the surfaces that define upper straight portion 266 of the adapter 260. There is a positive driving relationship between the drill steel and the adapter 260 via the connection between the upper straight portion 266 of the adapter 260 and the conventional straight drill steel. Retainer ring 272 is compressed so as to expand radially outwardly against the wall of the bore of the conventional straight drill steel thereby frictionally engaging the bore wall. This frictional engagement helps maintain the connection between the drill steel and the adapter.

The connection between the drill steel with the twisted portion to the adapter 260 at the twisted hexagonal portion 268 thereof is such that the surfaces that define the bore of the drill steel with the twisted portion contact the twisted surfaces of the twisted hexagonal portion 268 of the adapter 260 so as to create a positive driving relationship therebetween.

The connection between the adapter 260 and the drill steel with the twisted portion is secure due to the twist in that the drill steel will not become disconnected from the adapter if the drill steel (or any other part of the drilling apparatus) snags the earth strata upon removal of the drilling assembly from the hole.

Figure 19:
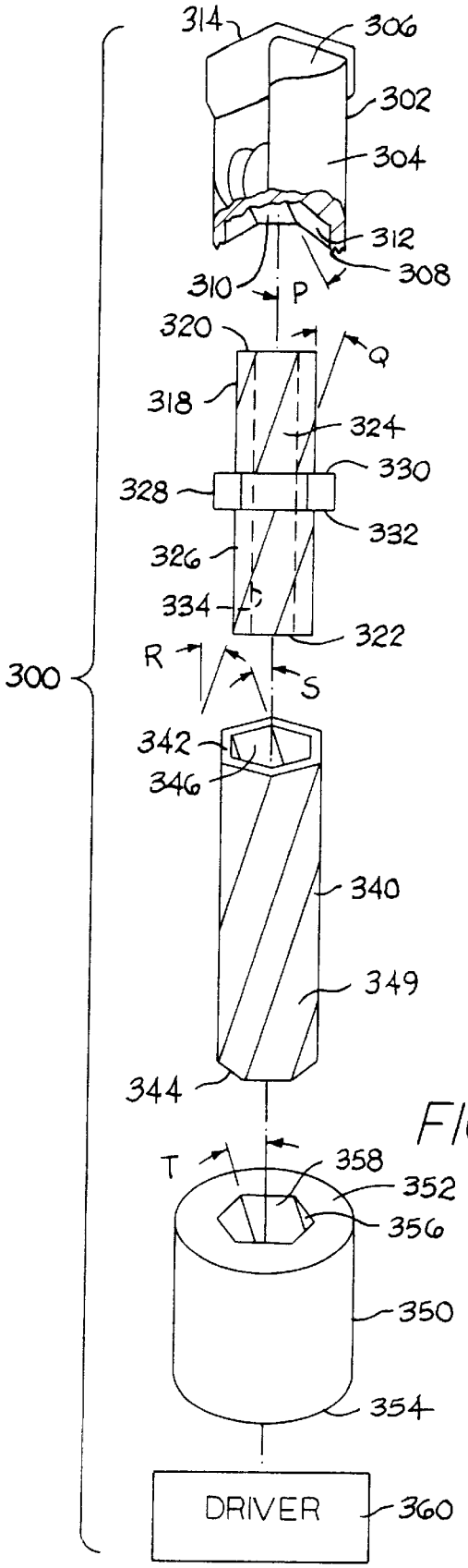
FIG. 19 is an isometric view of still another specific embodiment of a roof drilling assembly wherein the drill steel presents a twisted configuration along the entire length thereof and the components of the assembly are exploded away from each other.

FIG. 19 illustrates still another specific embodiment of a roof drilling assembly illustrated in brackets as 300. Roof drilling assembly 300 includes a roof drill bit 302 that has an elongate steel bit body 304. The bit body 304 has an axially forward end 306 and an axially rearward end 308. FIG. 19 shows a portion of the bit body 304 cut away so as to expose a central bore 310 that has a twisted hexagonal portion 312 adjacent the axially rearward end 308 of the bit body 304. The angle of twist "P" is equal to about twelve degrees; however, angle "P" may range between about zero degrees and about forty-five degrees, and more preferably may range between about five degrees and twenty degrees depending upon the specific application.

The bit body 304 receives a blade-style hard insert 314 affixed in a slot at the axially forward end 306 thereof. The hard insert 314 is typically affixed by brazing. The hard insert 314 is typically made of cemented (cobalt) tungsten carbide.

Figure 14:
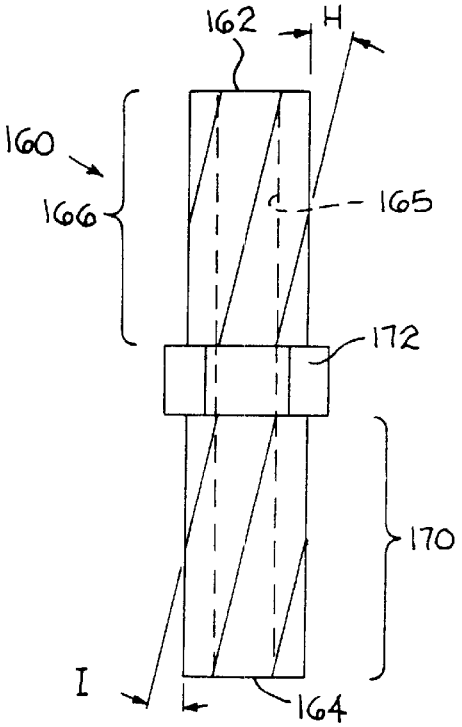
FIG. 14 is a side view of the specific embodiment of the adapter of FIG. 13.
Figure 15:
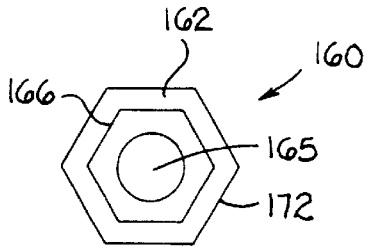
FIG. 15 is a top view of the adapter of FIG. 13.

The roof drilling assembly 300 further includes an adapter 318 that is structurally like the adapter 160 illustrated in FIG. 14 hereof. The adapter 318 includes an axially forward end 320 and a axially rearward end 322. The adapter 318 further presents a forward twisted portion 324 adjacent the axially forward end 320 and a rearward twisted portion 326 adjacent to the axially rearward end 322. The forward twisted portion 324 and the rearward twisted portion 326 have an angle of twist "Q" and "R", respectively. Angles "Q" and "R" each equal about twelve degrees. These angles "Q" and "R"may range between about zero degrees and about forty-five degrees, and more preferably may range between about five degrees and twenty degrees depending upon the specific application. The adapter 318 also has a central longitudinal bore 334 that extends along the entire length thereof. The adapter 318 further has a hexagonal enlarged dimension collar 328 that separates the forward twisted portion 324 from the rearward twisted portion 326. The collar 328 has a forwardly facing shoulder 330 and a rearwardly facing shoulder 332.

The roof drilling assembly 300 also includes an elongate twisted drill steel 340 that has an axially forward end 342 and an axially rearward end 344. A central longitudinal bore 346 extends along the entire length of the twisted drill steel 340. The twisted drill steel 340 has an interior twisted surface 348 that is disposed at an angle of twist "S". Angle of twist "S" is equal to about twelve degrees. This angle "S" may range between about zero degrees and about forty-five degrees, and more preferably may range between about five degrees and twenty degrees depending upon the specific application.

The twisted drill steel 340 also has an exterior surface 349 that presents a twisted surface that extends along the entire length of the drill steel. The angle of twist of the twisted exterior surface 349 corresponds to the interior twisted surface 348. Like for the angle of twist "S", the angle of twist of the exterior surface 349 may range between about five degrees and twenty degrees depending upon the specific application.

The roof drilling assembly 300 has a chuck 350 that has an axially forward end 352 and an axially rearward end 354. The chuck 350 further contains a twisted bore 356. The twisted bore 356 has an interior surface 358 that has an angle of twist "T" equal to about twelve degrees. This angle "T" may range between about zero degrees and about forty-five degrees, and more preferably may range between about five degrees and twenty degrees depending upon the specific application.

Finally, the roof drilling assembly 300 includes a machine that rotates the assembly wherein the machine is illustrated in mechanical schematic in FIG. 19 as the "DRIVER" 360. DRIVER 360 is operatively connected to the chuck 350.

In regard to the connection of the roof drilling assembly 300, the driver 360 connects to the chuck 350 in such a fashion that there is a positive driving connection therebetween. The axially rearward end 344 of the twisted drill steel 340 is received within the twisted bore 356 of the chuck 350. The external surfaces that define the twisted hexagonal drill steel 340 contact the surfaces that define the twisted bore 356 of the chuck 350 so that there is a positive driving connection between the drill steel 340 and the chuck 350.

The twisted drill steel 340 generally is made in standard lengths. Because the twist extends along the entire axial length of the drill steel 340, it may be cut to any length to accommodate a specific situation and still provide the advantages set forth herein.

The rearward twisted portion 326 of the adapter 318 is received within the bore 346 of the twisted drill steel 340 near the axially forward end 342 of the drill steel 340. The external surfaces that define the rearward twisted surface 326 of the adapter 318 contact the internal surfaces that define the bore 346 of the twisted drill steel 340 so as to obtain a positive driving connection between the drill steel and the adapter. The axially forward end 342 of the drill steel 340 typically contacts the rearwardly facing shoulder 332 of the collar 328.

The axially forward twisted portion 324 of the adapter 318 is received within the central bore 310 of the roof drill bit 302. The surfaces that define the axially forward twisted portion 324 of the adapter 318 engage the surfaces that define the twisted portion 312 of the central bore 310 of the roof drill bit 302 so as to obtain a positive driving connection therebetween.

It should be appreciated that the specific embodiment of FIG. 19 provides a roof drilling assembly 300 that provides components that easily connect and disconnect and still exhibit a positive driving connection therebetween. Still further, these components provide a connection therebetween that remains intact even when the drilling assembly becomes snagged on the earth strata that defines the bore hole. Because the one embodiment of the drill steel as illustrated in FIG. 19 has a twisted configuration along its entire length, the drill steel may be cut to any length and still provide the above-mentioned advantages of the roof drilling assembly.

The patents and other documents identified herein are hereby incorporated by reference herein.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A drill steel-chuck assembly comprising:

a drill steel having a plurality of faces;

the drill steel having opposite ends;

the drill steel having one portion adjacent one of the opposite ends thereof, the drill steel having a mediate portion spaced apart from the one portion, and the drill steel having one transition portion between the one portion and the mediate portion so as to join the one portion and the mediate portion;

the one portion of the drill steel presenting a first orientation of the faces, and the mediate portion of the drill steel presenting a second orientation of the faces;

the one transition portion of the drill steel presenting a twisted orientation of the faces comprising a generally constant twist of the faces from the first orientation of the one portion to the second orientation of the mediate portion; and a chuck for attachment to the drill steel through engagement with the transition portion of the drill steel.

2. The assembly of claim 1 wherein the chuck containing a central bore having a plurality of lobes wherein the lobes correspond to the faces of the drill steel.

3. The assembly of claim 2 wherein each one of the lobes has an arcuate portion and a straight portion.

4. The assembly of claim 3 wherein when the drill steel and the chuck are in a driving relationship, each one of the faces of the drill steel engages the straight portion of its corresponding lobe.

5. The assembly of claim 2 wherein the chuck having opposite ends, and the central bore of the chuck extending between the opposite ends of the chuck; and the central bore of the chuck having a straight axial portion adjacent to the one end of the chuck, the central bore of the chuck further having another straight axial portion adjacent to the other end of the chuck, and the central bore further having a twisted mediate axial portion between the one straight axial portion and the other straight axial portion.

6. The assembly of claim 5 wherein the twisted mediate axial portion of the chuck presents a configuration that corresponds with the configuration of the twisted one transition portion of the drill steel.

7. The assembly of claim 6 wherein the twisted one transition portion of the drill steel presents an angle of twist equal to between about zero degrees and about twenty-six degrees.

8. The assembly of claim 6 wherein the twisted one transition portion of the drill steel presents an angle of twist equal to between about five degrees and about fifteen degrees.

9. The assembly of claim 6 wherein the angle of twist of the twisted one transition portion equals about twelve degrees.

10. The assembly of claim 5 wherein the twisted mediate axial portion of the chuck presents an angle of twist between about zero degrees and about twenty-six degrees.

11. The assembly of claim 5 wherein the twisted mediate axial portion of the chuck presents an angle of twist between about five degrees and about fifteen degrees.

12. The assembly of claim 5 wherein the twisted mediate axial portion of the chuck presents an angle of twist of about twelve degrees.

13. The assembly of claim 1 further comprising:

the drill steel having other portion adjacent to a second of said opposite ends;

the drill steel having another transition portion between the other portion and the mediate portion so as to join the other portion and the mediate portion;

the other portion of the drill steel presenting a third orientation of the faces, and the mediate portion of the drill steel presenting the second orientation of the faces; and the other transition portion of the drill steel presenting a twisted orientation of the faces comprising a generally constant twist of the faces from the third orientation of the one portion to the second orientation of the mediate portion.

14. The assembly of claim 1 wherein the chuck comprising:

a central bore having a plurality of lobes;

the central bore having one axial section wherein the lobes present one orientation, the central bore having another axial section wherein the lobes present another orientation, and the central bore having a mediate axial portion providing a juncture between the one axial section and the other axial section of the central bore; and the mediate axial portion of the central bore presenting lobes which twist so as to provide for the consistent transition between the one orientation of the lobes of the one axial portion of the central bore and the other orientation of the lobes of the other axial portion of the central bore.

15. A drilling assembly comprising:

a cutting bit;

a drill steel having plurality of faces, the drill steel having opposite ends;

the cutting bit being in operative connection to the drill steel at one end thereof;

the drill steel having one portion adjacent one of the opposite ends thereof, the drill steel having a mediate portion spaced apart from the one portion, and the drill steel having one transition portion between the one portion and the mediate portion so as to join the one portion and the mediate portion;

the one portion of the drill steel presenting one orientation of the faces, and the mediate portion of the drill steel presenting another orientation of the faces;

the one transition portion of the drill steel presenting a twisted orientation of the faces comprising a generally constant twist of the faces from the one orientation of the one portion to the other orientation of the mediate portion; and a chuck for attachment to the drill steel through engagement with the transition portion of the drill steel.

16. The assembly of claim 15 wherein further including an adapter, and the adapter being received by the cutting bit and by the drill steel so as to detachably connect together the cutting bit and the drill steel.

17. An adapter for use in connecting a pair of drill steels wherein adjacent ends of the drill steels present a bore with a twisted portion, the adapter comprising:

an elongate body having an upper end and a lower end;

the elongate body presenting a twisted upper portion adjacent to the upper end thereof, and the elongate body presenting a lower twisted portion adjacent to the lower end thereof;

the angle of twist of the upper twisted portion corresponding to the angle of twist of the twisted portion of the bore in one of said pair of drill steels so that when the upper twisted portion of the adapter engages one of said pair of drill steels there is a secure attachment therebetween; and the angle of twist of the lower twisted portion corresponding to the angle of twist of the twisted portion of the bore in one of said pair of drill steels so that when the lower twisted portion of the adapter engages one of said pair of drill steels there is a secure attachment therebetween; and a collar between the twisted upper portion and the lower twisted portion so as to separate the twisted upper portion from the lower twisted portion.

18. The adapter of claim 17 wherein the transverse dimension of the collar is about equal to the transverse dimension of the drill steels.

19. The adapter of claim 17 wherein the upper twisted portion presents an angle of twist equal to between about zero degrees and about forty-five degrees; and the lower twisted portion presents an angle of twist equal to between about zero degrees and about forty-five degrees.

20. An adapter for use in connecting a drill steel having a substantially straight bore and a chuck wherein the chuck presents a bore with a twisted portion, the adapter comprising:

an elongate body having opposite ends;

the elongate body presenting a straight portion adjacent one of said opposite ends;

the elongate body presenting a twisted portion adjacent to a second of said opposite ends of the elongate body; and the angle of twist of the twisted portion of the elongate body corresponding to the angle of twist of the central bore of the chuck so that when the twisted portion of the adapter engages chuck there is a secure attachment between the adapter and the chuck.

21. The adapter of claim 20 wherein the straight portion of the elongate body containing a groove, and the groove carrying a resilient retainer ring; and when the adapter is assembled to the chuck the resilient ring engages the central bore of the chuck.

22. The adapter of claim 20 wherein a portion of the twisted portion of the elongate body of the adapter is disposed at an angle of twist.

23. The adapter of claim 22 wherein all of the twisted portion of the elongate body of the adapter is disposed at the angle of twist.

24. The adapter of claim 20 wherein the external surface of the elongate body of the adapter defining the twisted portion.

25. A drill steel comprising:

an elongate body having an axial forward end and an axial rearward end, the elongate body containing a longitudinal bore presenting a twisted configuration, and the twisted configuration existing along substantially the entire length of the longitudinal bore, wherein the longitudinal bore presents a hexagonal configuration.

26. The drill steel of claim 25 wherein the twisted configuration of the longitudinal bore extending from the axially forward end to the axially rearward end of the bore.

27. The drill steel of claim 25 wherein the longitudinal bore of the twisted configuration exhibits an angle of twist ranging between about zero degrees and about forty-five degrees.

28. A drill steel comprising:

an elongate body having an axial forward end and an axial rearward end, the elongate body containing a longitudinal bore presenting a twisted configuration, and the twisted configuration existing along substantially the entire length of the longitudinal bore wherein an external surface of the elongate body presents a twisted hexagonal configuration.

29. The drill steel of claim 28 wherein the twisted configuration of the external surface of the elongate body corresponds to the twisted configuration of the longitudinal bore.

30. The drill steel of claim 28 wherein the twisted configuration of the external surface of the elongate body extending from the axially forward end to the axially rearward end of the elongate body.

31. The drill steel of claim 28 wherein the external surface of the elongate body with the twisted configuration exhibits an angle of twist ranging between about zero degrees and about forty-five degrees.

32. A drilling assembly comprising:

a cutting bit;

a drill steel, the drill steel having an elongate body with an axially forward end and an axially rearward end, the elongate body containing a longitudinal bore presenting a twisted configuration, and the twisted configuration existing along at least half the entire length of the longitudinal bore;

the cutting bit being operatively connected to the axially forward end of the drill steel;

a chuck containing a central bore, and the chuck being connected to the drill steel wherein the axially rearward end of the drill steel being received within the central bore of the chuck; and wherein the central bore of the chuck presents a twisted configuration, the drill steel presenting an exterior surface having a twisted configuration corresponding to the twisted configuration of the longitudinal bore, and the twisted configuration of the central bore of the chuck corresponding to the twisted configuration of the exterior surface of the drill steel.

33. A drilling assembly comprising:

a drill steel, the drill steel having an elongate body with an axially forward end and an axially rearward end, the elongate body containing a longitudinal bore presenting a twisted configuration;

a chuck containing a central bore, and the chuck being connected to the drill steel wherein the axially rearward end of the drill steel being received within the central bore of the chuck; and wherein the central bore of the chuck presents a twisted configuration, the drill steel presenting an exterior surface having a twisted configuration corresponding to the twisted configuration of the longitudinal bore, and the twisted configuration of the central bore of the chuck corresponding to the twisted configuration of the exterior surface of the drill steel.

* * * * *